US006105566A

United States Patent [19]

Tiedemann

[11] Patent Number: 6,105,566

[45] Date of Patent: Aug. 22, 2000

[54] ADJUSTABLE BOW-MOUNTED QUIVER

[76] Inventor: Larry E. Tiedemann, Rte. 1, Box 159, Winona, Minn. 55987

[21] Appl. No.: 09/460,097

[22] Filed: Dec. 13, 1999

[51] Int. Cl.[7] ..... F41B 5/06

[52] U.S. Cl. ..... 124/86; 124/25.7; 224/916

[58] Field of Search ..... 124/23.1, 25.5, 124/25.7, 86; 224/916

[56] References Cited

U.S. PATENT DOCUMENTS

| | | | |
|---|---|---|---|
| 2,464,068 | 3/1949 | Bear | 124/25.7 |
| 3,591,062 | 7/1971 | Karbo | 124/25.7 X |
| 4,247,027 | 1/1981 | Tardiff | 124/25.7 X |
| 5,190,022 | 3/1993 | Larson | 124/25.7 |
| 5,803,069 | 9/1998 | Schreiber | 124/86 |

OTHER PUBLICATIONS

"A–Dapta–Quiver" Brochure; DBS Tool and Die, Inc.; Onalaska, WI, USA.

*Primary Examiner*—John A. Ricci
*Attorney, Agent, or Firm*—Robert J. Harter

[57] ABSTRACT

A bow-mounted quiver includes a novel bracket and a lightweight, dual-wire frame that renders the quiver adjustable vertically and rotationally relative to the bow to which it is mounted. The quiver includes an arrow keeper that is adapted to hold arrows of various shaft diameters without adjustment. The arrow keeper includes a novel arrow-gripping notch that allows an arrow to be installed and removed silently.

18 Claims, 5 Drawing Sheets

ADJUSTABLE BOW-MOUNTED QUIVER

BACKGROUND OF THE INVENTION

1. Field of the Invention

The subject invention generally pertains to bow-mounted quivers, and more specifically to one that is adjustable.

2. Description of Related Art

A convenient location to carry a quiver of arrows is on the bow itself. To mount a quiver or other accessory (e.g., sites, rests, etc.) on a bow, many bows, especially compound bows, have two threaded mounting holes of standard size and spacing (10–24 threads, 1 5/16 in. apart) located on the riser or handle portion of the bow. This allows a conventional quiver to be simply screwed onto the bow.

However, there are at least six problems with current bow-mounted quivers. First, conventional quivers are mounted in a fixed relationship to the bow, as determined by the location of the bow's standard mounting holes. Depending on the designs of the bow and the quiver, the quiver may or may not be in a good location. A quiver of arrows may be too high, too low, or tilted at a bad angle. A poor location can make it difficult for an archer to quickly remove arrows in rapid succession. Also, if the location of the quiver places either end of the arrows too far beyond the envelope or periphery of the bow, the arrows may tend to snag branches as an archer carries the bow through the woods.

Second, the standard mounting holes may not be available for mounting a quiver. Sometimes the holes are already being used to hold another bow accessory. Some bows, such as custom or semi-custom recurve, longbows, straight bows, self-bows, and other traditional style bows do not even have such mounting holes for purposes of appearance or bow strength.

Third, numerous accessories such as sites, stabilizers, as well as quivers themselves all add weight to a bow. The heavier the bow, the more difficult it becomes to hold a steady aim.

Fourth, it is difficult to provide a bow-mounted quiver that adapts to the various shaft diameters of arrows. Standard diameters range from about 0.200 in. for carbon or graphite arrows to about 0.360 in. for wood arrows. With conventional quivers, the arrow shafts usually snap into a resilient arrow keeper located at the lower end of the quiver. Larger diameter shafts are often hard to snap in and out, while the narrower shafts tend to slip back out. Some quivers have an adjustable arrow keeper, however, that can add unnecessary complexity and weight.

Fifth, the snap-in action of conventional arrow keepers creates an undesirable snapping noise as an arrow is inserted or removed. When a hunter attempts to take a second shot at an animal, the noise is often enough to scare the animal away.

Sixth, when a bow hunter is in a tree stand or hidden amid brush in wait for game, a bow-mounted quiver tends to get in the way. In such situations, often it is desirable to temporarily remove the quiver and set it off to the side or hang it from a branch. Unfortunately, removing a quiver usually requires tools and leaves small loose parts, such as the mounting screws, that can easily be lost.

SUMMARY OF THE INVENTION

To overcome the problems and limitations of current bow-mounted quivers, it is an object of the invention to provide a bow-mounted quiver that is both vertically and rotationally adjustable relative to the bow, and do so by way of a single screw.

A second object is to provide a quiver that is easily removable without tools and loose parts.

A third object is to provide a quiver that grips a wide range of arrow shaft diameters without having to adjust an arrow keeper.

A fourth object is to provide arrow keeper for a quiver that allows smaller arrows to slip in and out without a hard snap.

A fifth object is to provide a bow-mounted quiver that is infinitely adjustable in a vertical direction.

A sixth object is to provide a bow-mounted quiver that is rotationally adjustable in discrete increments to achieve a high holding torque at each increment without having to rely on friction alone.

A seventh object is to provide a bow-mounted quiver having a wire frame that is lightweight yet strong.

These and other objects of the invention are provided by novel bow-mounted quiver whose position is adjustable vertically or rotationally and includes an arrow keeper adapted to hold arrows of various shaft diameters.

DESCRIPTION OF THE PREFERRED EMBODIMENT

Figure 1:
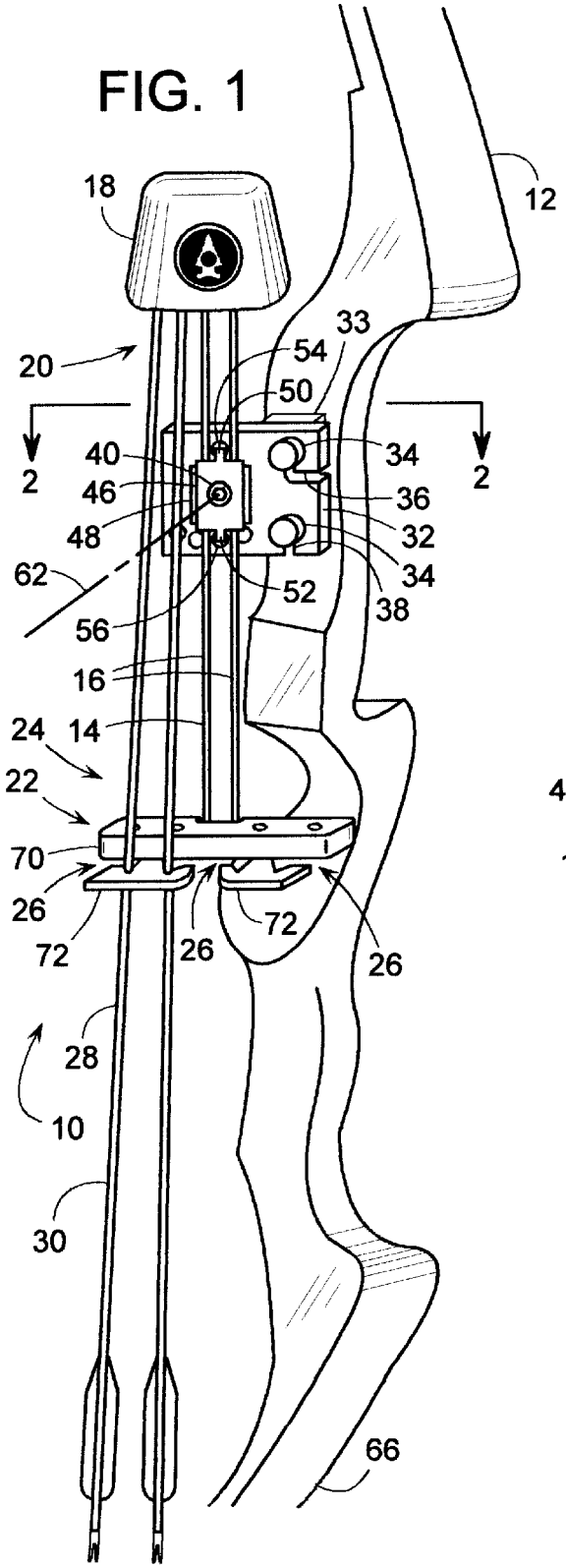
FIG. 1 is a perspective view of a quiver assembly mounted to a bow according to one embodiment of the invention.

In FIG. 1, a quiver assembly 10 is shown attached to a bow 12. Although bow 12, in this example, happens to be a compound bow, bow 12 actually represents any of a variety of bows including, but not limited to, recurve bows, longbows, straight bows, self-bows, custom, and semi-custom bows. Quiver 10 includes a quiver frame 14 preferably comprising a steel wire track 16 (Bright Basic wire; 0.150 in. dia.) with a cap 18 attached at an upper end 20 of frame 14 and an arrow keeper 22 attached at a lower end 24. The term, "track" refers to a structure having a travel length along which a second element may travel without the second element having to be completely disconnected from the structure. Arrow keeper 22 includes several notches 26 that can each releasably hold a shaft 28 of an arrow 30. Cap 18 provides a protective shield around the points of the arrows, while a foam pad inside cap 18 helps keep the points of the arrows from rattling around inside the cap.

A bracket 32 couples quiver frame 14 to bow 12, regardless of whether bow 12 is right-hand or left-hand. Bracket 32 also allows quiver frame 14 to be easily adjusted vertically and/or rotationally relative to bow 12. If the bow includes the two standard 10–24 mounting holes at 1 5/16 inches apart, then bracket 32 can be installed by using those holes. Two 10–24 thumb screws 34 are preferably used to allow quiver 10 to be readily removed without tools. In some embodiments, a ¼-inch rubber gasket or pad 33 having two holes spaced 1 5/16 inches apart and aligned with the bow's 10–24 mounting holes provides some shock-absorbing isolation between bow 12 and bracket 32. Open slots 36 and 38 in bracket 32 allow removal without leaving any loose parts, as screws 34 can always be left in the mounting holes.

Figure 2:
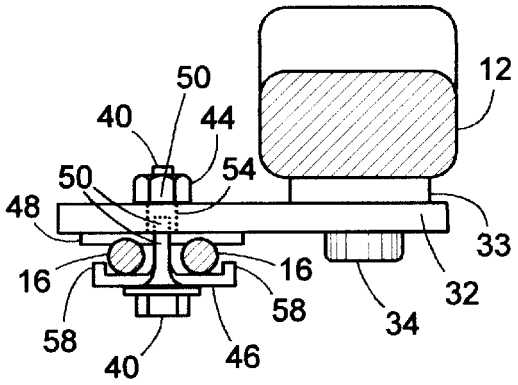
FIG. 2 is a cross-sectional view taken along line 2—2 of FIG. 1.

Referring further to FIG. 2, a single screw 40 extending through a slot 42 (FIGS. 3 and 4) and threaded into a nut 44 that is behind bracket 32 clamps track 16 between a clamp plate 46 and bracket 32. In some embodiments, nut 44 is kept from rotating by engaging the edges of slot 42; however, a conventional nut could also be used. A rubber, polymeric, or other high-friction spacer, such as a gripper 48 is also clamped between track 16 and bracket 32 to provide a frictional connection between the two, and thus firmly fix quiver assembly 10 to bow 12. Two protrusions, such as formed tabs 50 and 52, extend into two corresponding holes 54 and 56 in bracket 32 to limit rotational movement between bracket 32 and clamp plate 46. Two formed flanges 58 add rigidity to clamp plate 46 and help hold wire track 16 within clamp plate 46.

Figure 3:
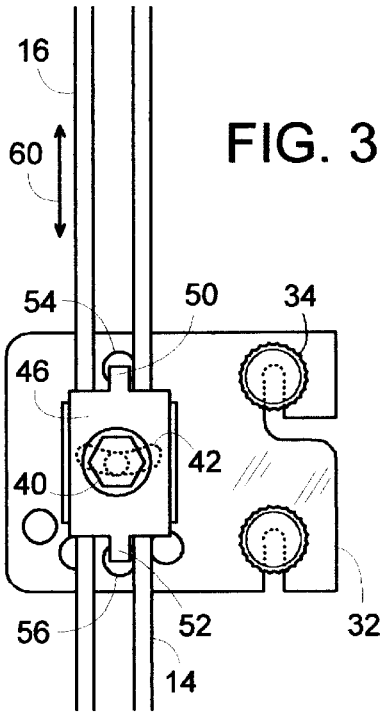
FIG. 3 is a front view of a clamp plate and bracket in one configuration.
Figure 4:
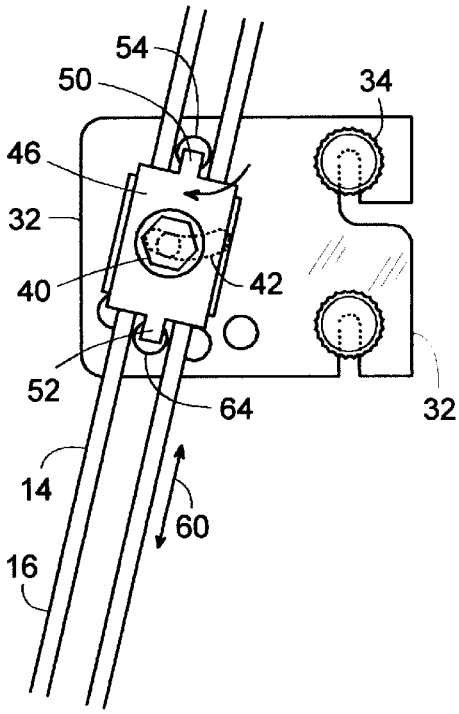
FIG. 4 is a front view of a clamp plate and bracket in another configuration.

Vertical adjustment or translation of quiver frame 14 relative to bracket 32 can be achieved by loosening screw 40. Relative sliding between bracket 32 and track 16 allows frame 14 to be slid up or down infinitely along a travel length 60 of track 16, as shown in FIG. 3. Further loosening of screw 40 allows tab 52 of clamp plate 46 to back out from within hole 56. This allows frame 14, as well as cap 18 and arrow keeper 22, to rotate about an axis 62 defined by tab 50 rotating within hole 54, as shown in FIG. 4. The length of slot 42 in bracket 32 allows screw 40 to move with the rotation of clamp plate 46. Reinserting tab 52 into another hole 64 helps hold a fixed rotational relationship between bracket 32 and clamp plate 46, which thus fixes the rotational relationship between quiver frame 14 and bow 12 without having to rely on friction alone. Bracket 32 includes several holes 56, 64, and others to render quiver frame 14 rotationally adjustable in discrete angular increments.

Figure 5:
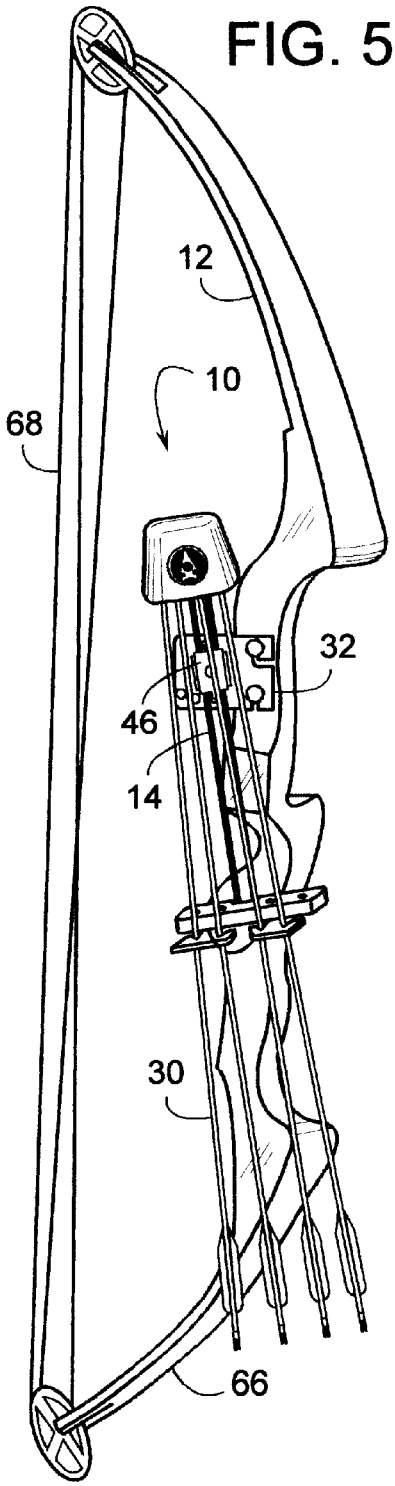
FIG. 5 is a perspective view of a quiver assembly mounted to a bow in one position.
Figure 6:
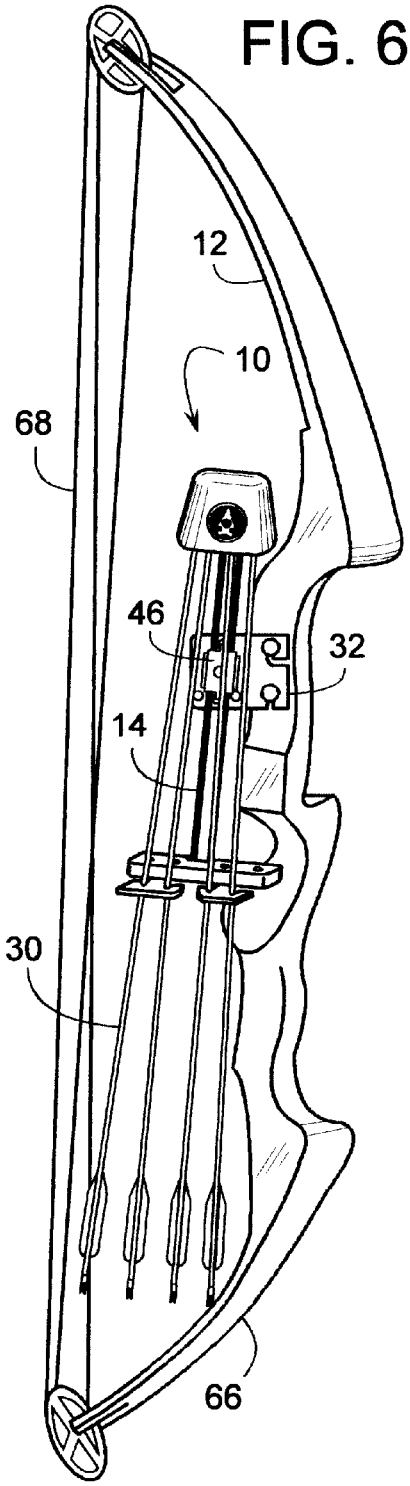
FIG. 6 is a perspective view of a quiver assembly mounted to a bow in another position.

Together, the translation and rotation of quiver frame 14, allows quiver assembly 10 to be properly positioned relative to bow 12. For example, if quiver assembly 10 is too low and tilts the feathers of arrow 30 beyond the a lower limb 66 of bow 12, as shown in FIG. 5, frame 14 can be tilted back and raised, as shown in FIG. 6. "Tucking" the feathers of arrows 30 between a string 68 and lower limb 66 of bow 12, as shown in FIG. 6, is generally preferred; however, any position, including that of FIG. 5, may be preferred depending on the personal preferences of the user.

Figure 7:
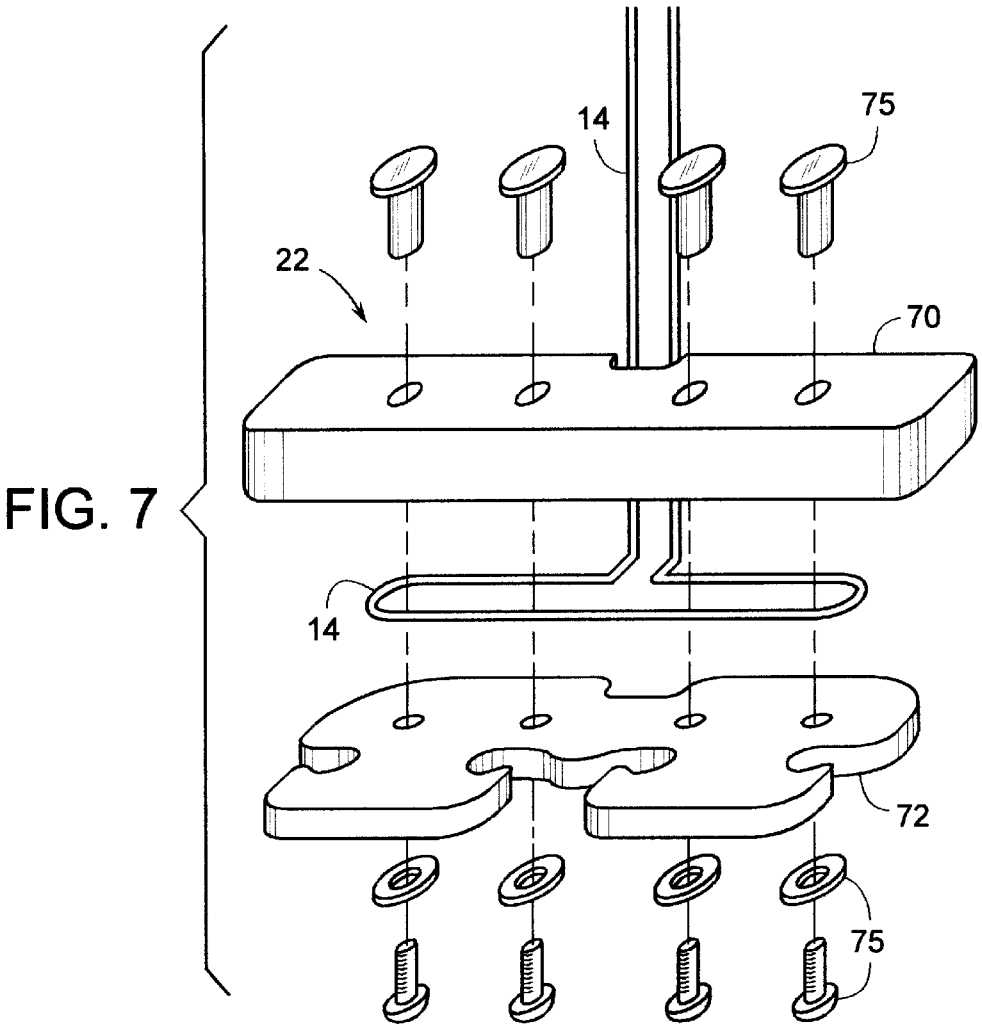
FIG. 7 is an exploded view of an arrow keeper of a quiver assembly according to one embodiment of the invention.
Figure 8:
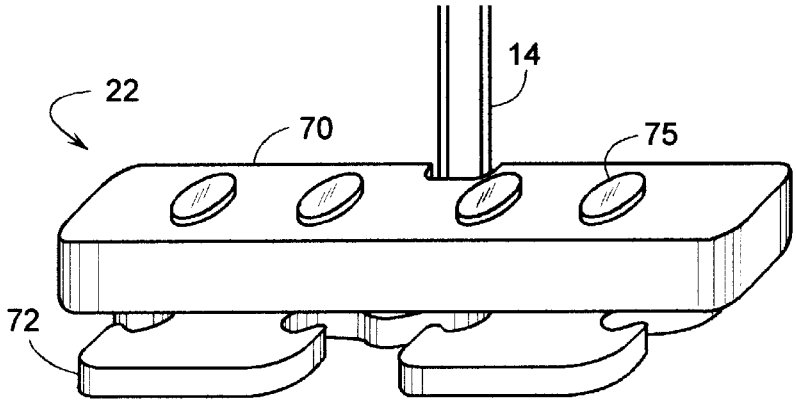
FIG. 8 is a perspective view of an arrow keeper of a quiver assembly according to one embodiment of the invention.

To ensure that quiver assembly 10 is able to effectively hold arrows of various diameter, arrow keeper 22 is constructed as shown in FIGS. 7 and 8. Wire frame 14 is sandwiched between a cushion 70 and a contoured abutment 72, and the three are held together by any of a variety of fasteners 75, such as an assembly of a screw, nut, washers, and perhaps a sleeve about the shank of the screw to prevent the tightening of the nut from crushing cushion 70. In the illustrated embodiment, each fastener 75 includes a flanged ferrule made of steel and having a broad one-inch diameter head at one end and a tapped blind hole at an opposite end. A 10–32 screw (with an optional washer) screws into the ferrule's blind hole, while the shank of the ferrule prevents fastener 75 from crushing cushion 70. In a currently preferred embodiment, cushion 70 is a half-inch to one-inch thick resilient, compressible polyurethane foam, such as PORON, which is a registered trademark of the Rogers Corporation, of Woodstock, Conn. However, cushion 70 represents any spring-like member or material that can resiliently urge an arrow shaft against an opposing stop or abutment. In this example, abutment 72 comprises a ¼-inch thick E.P.D.M (ethylene-propylene) material of approximately 80 durometer. Such a material has the desirable strength, frictional, and sound dampening properties that help grip arrows 30 without transmitting an excessive amount of vibration from the bow to the arrow.

However, other materials of various hardness or even materials that are substantially rigid are well within the scope of the invention.

Figure 9:
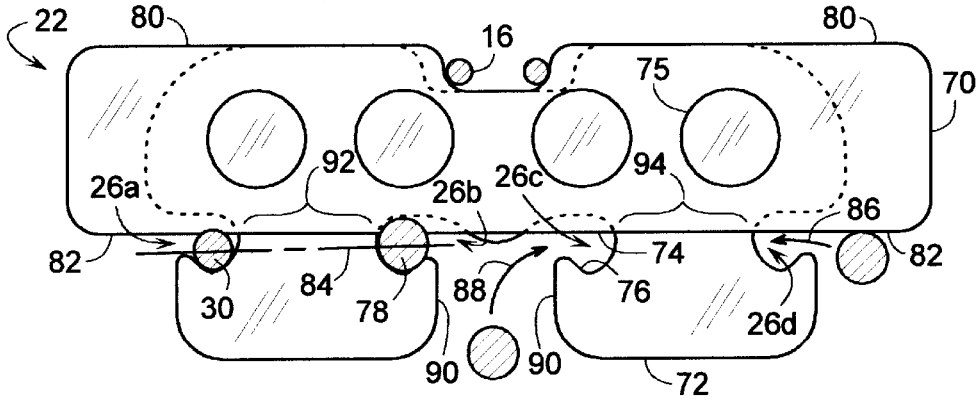
FIG. 9 is a top view of an arrow keeper of a quiver assembly according to one embodiment of the invention.

Referring to FIG. 9, a first surface 74 of cushion 70 and a second surface 76 of said abutment 72 define several slots or notches 26*a–d* with sufficient pliability for each to receive and hold arrow 30 having a 0.200 inch shaft diameter or arrow 78 having a 0.360 inch shaft diameter. To grip such a wide range of arrow shaft diameters, cushion 70 is preferably more pliable than abutment 72. The relative high pliability of cushion 70 provides the give to accommodate the various shaft diameters. While the relative rigidity of abutment 72 in conjunction with its generally V-shape of its portion of notch 26*a*, 26*b*, 26*c* or 26*d* establishes a relatively fixed support or somewhat of a datum that holds the arrow shaft in place. The unique design of arrow keeper 22 provides several other key features.

With cushion 70 being more pliable than abutment 72, arrows 30 and 78 can be quietly slipped in and out of notches 26*a–d* (if desired). This is achieved by forcing the arrow shaft into cushion 70 until there is sufficient clearance for the arrow shaft to readily slip between cushion 70 and abutment 72. An extension 80 at each end of cushion 70 provides somewhat of a "landing area" or guide surface 82 that helps guide arrow 30 or 78 into notch 26*a* or 26*d*. Notches 26*a–d* may lie in a line or a curve; however, any two notches, such as notch 26*a* and 26*b*, define a straight line 84 that intersects a center point of the two arrows that are in those notches. Line 84 is parallel or collinear with or at least disposed at an angle of less than 90 degrees to a shaft entry pathway, such as pathways 86 and 88 respectively. When an arrow shaft slips into a notch, the path of the arrow shifts off its initial travel path. This hook-in feature allows abutment 72 to more effectively capture or hold an arrow shaft within slots 26*a–d*. Notches 26*b* and 26*c* share a common shaft lead-in 90 to maximize the amount of material and thus strength of abutment 72 in an area 92 between notches 26*a* and 26*b* and in an area 94 between notches 26*c* and 26*d*.

Figure 10:
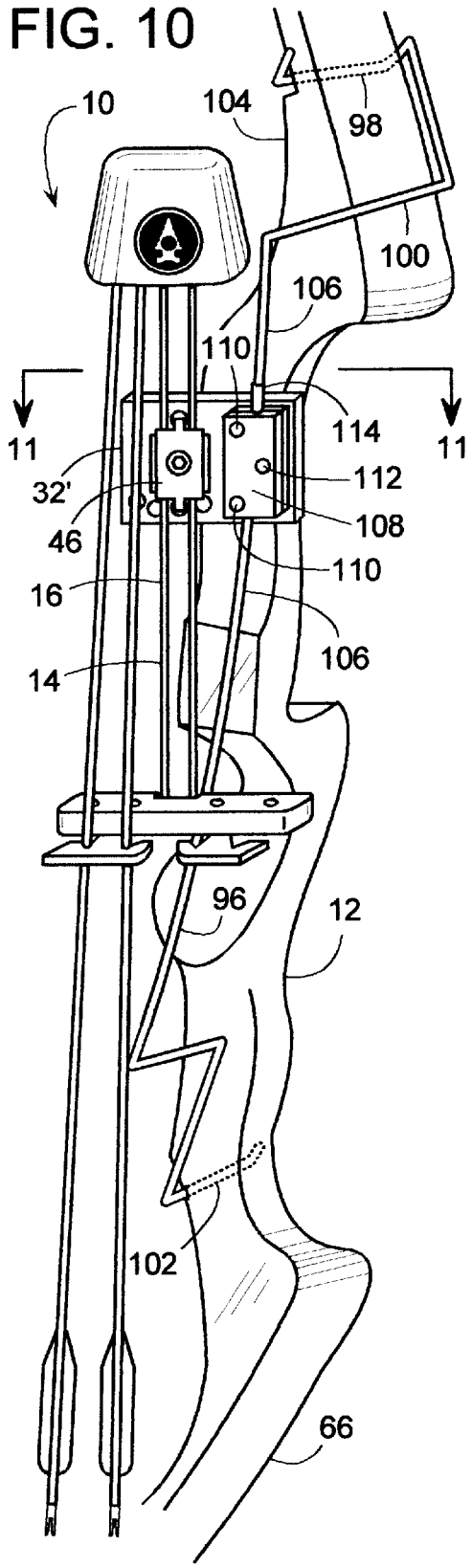
FIG. 10 is a perspective view of a quiver assembly mounted to a bow according to another embodiment of the invention.
Figure 11:
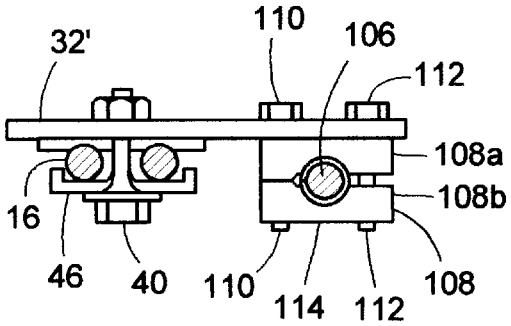
FIG. 11 is a cross-sectional view taken along line 11—11 of FIG. 10.

In an alternate embodiment, shown in FIGS. 10 and 11, a bracket 32' is coupled to bow 12 by way of a wire main frame 96, rather than using the two standard mounting holes that are meant for mounting various bow accessories. Main frame 96 comprises a 3/16 inch diameter, 1065 MB hard drawn spring wire (MB representing mechanical bright). Main frame 96 includes three lateral segments 98, 100 and 102 that create a binding action that holds frame 96 to bow 12. When installing, main frame 96 is initially in a relaxed state. The two upper segments 98 and 100 engage opposite faces of an upper limb 104, which places the lower segment 102 well in front of lower limb 66. Lower segment 102 is then manually pulled behind lower limb 66, which causes a main riser segment 106 to resiliently bend. The bending action of riser 106 creates the binding forces that frictionally hold segments 98, 100 and 102 onto the limbs of bow 12.

An adaptor 108 couples bracket 32' to riser segment 106. Adaptor 108 includes three screws. Two screws 110 are primarily for holding adaptor halves 108*a* and 108*b* together, as well as for connecting adaptor 108 to bracket 32'. Another screw 112 serves to tightly clamp adaptor halves 108*a* and 108*b* to riser 106. Thus, a single screw 112 can be used to tighten or adjust bracket 32 relative to riser 106. A tubular polymeric gripper 114 (e.g., rubber tubing) is pinched between adaptor 108 and riser 106 to increase the frictional grip between the two. Gripper 114 is preferably slit lengthwise to facilitate its installation around riser 106. This particular embodiment provides almost all the features of the previously described embodiment, and further allows quiver assembly 10, along with main frame 96, to be easily removed and reinstalled on almost any bow 12.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A quiver assembly attachable to a bow and adapted to hold an arrow, comprising:

quiver frame including an upper end, a lower end, and a track having a travel length extending in a first direction;

a cap attached to said upper end of said frame and being adapted to receive a pointed end of said arrow;

an arrow keeper attached to said lower end of said frame and defining at least one notch adapted to receive and releasably hold a shaft of said arrow; and a bracket adapted to couple said quiver frame to said to said bow and being attached to said quiver frame at a position that is adjustable relative thereto in translation and rotation, wherein said translation provides a variable position of said bracket along said track, and wherein said rotation defines an axis traversing said first direction to render said quiver frame, said cap, and said arrow keeper rotatably adjustable relative to said bracket.

2. The quiver assembly of claim 1, further comprising a wire main frame having a resilience that allows said wire main frame to releasably attach to said bow, wherein said bracket is adapted to couple said quiver frame to said bow by way of said wire main frame.

3. The quiver assembly of claim 2, further comprising a polymeric gripper interposed between said bracket and said wire main frame to provide a frictional connection therebetween.

4. The quiver assembly of claim 1, wherein said track provides infinite translation adjustment of said bracket along said travel length.

5. The quiver assembly of claim 1, further comprising a polymeric gripper interposed between said bracket and said quiver frame to provide a frictional connection therebetween.

6. The quiver assembly of claim 1, wherein said bracket is selectively fixed and adjustable relative to said quiver frame by virtue of selectively tightening and loosening just one screw.

7. The quiver assembly of claim 1, said position of said bracket is adjustable in rotation relative to said quiver frame in a plurality of discrete increments.

8. The quiver assembly of claim 7, further comprising a clamp plate attached to said bracket with said quiver frame clamped therebetween, wherein at least one of said clamp plate and said bracket defines a plurality of holes and at least one of said clamp plate and said bracket includes a protrusion that selectively extends into one of said plurality of holes to provide said plurality of discrete increments.

9. The quiver assembly of claim 1, wherein said quiver frame includes a wire.

10. The quiver assembly of claim 9, wherein said frame includes two substantially parallel wires that provide said track.

11. A quiver assembly attachable to a bow and adapted to selectively hold a first arrow having a shaft of a first diameter and a second arrow of a relatively smaller shaft diameter, comprising:

a quiver frame including an upper end and a lower end;

a cap attached to said upper end of said frame and being adapted to receive a pointed end of at least one of said first arrow and said second arrow;

an arrow keeper attached to said lower end and including an abutment and a cushion, said abutment and said cushion defining a notch therebetween which is adapted to receive and hold said shaft, said cushion being more pliable than said abutment, whereby said cushion yields more than said abutment upon one of said first arrow and said second arrow being inserted into said notch.

12. The quiver assembly of claim 11, further comprising a plurality of notches each of which are defined as said notch, said plurality of notches defining a line, said plurality of notches each having a shaft entry pathway that lies at an angle of less than 90 degrees to said line.

13. The quiver assembly of claim 12, wherein said shaft entry pathway is substantially parallel to said line.

14. The quiver assembly of claim 12, wherein said entry pathway of two of said plurality of notches share a common shaft lead-in that is defined by at least one of said cushion and said abutment.

15. The quiver assembly of claim 11, wherein said cushion and said abutment are vertically offset, with said vertical direction being defined as running from said lower end to said upper end.

16. The quiver assembly of claim 11, wherein said cushion is thicker than said abutment as measure in a vertical direction, with said vertical direction being defined as running from said lower end to said upper end.

17. The quiver assembly of claim 11, wherein said notch is defined by a first surface of said cushion and a second surface of said abutment, with said first surface and said second surface each having a different contour.

18. A quiver assembly attachable to a bow and adapted to hold an arrow, comprising:

a quiver frame including an upper end, a lower end, and a track;

a cap attached to said upper end of said frame and being adapted to receive a pointed end of said arrow;

an arrow keeper attached to said lower end and including an abutment and a cushion, said abutment and said cushion defining a notch therebetween which is adapted to receive and hold said shaft, said cushion being more pliable than said abutment; and a bracket adapted to couple said quiver frame to said bow and being attached to said quiver frame at a position that is adjustable in translation and rotation relative to said quiver frame, wherein said translation provides a variable position of said bracket along said track, and wherein said rotation defines an axis about which said quiver frame, said cap, and said arrow keeper are rotatably adjustable relative to said bracket.

* * * * *